US006053060A

United States Patent [19]

Tumberlinson et al.

[11] Patent Number: 6,053,060

[45] Date of Patent: Apr. 25, 2000

[54] TWO-PIECE PINION GEAR

[75] Inventors: Robert L. Tumberlinson, Brownsville; Mauricio Clarke, Harlingen, both of Tex.

[73] Assignee: Johnson Electric Automotive, Inc., Plymouth, Mich.

[21] Appl. No.: 08/989,804

[22] Filed: Dec. 12, 1997

[51] Int. Cl.[7] ..... F02N 15/00

[52] U.S. Cl. ..... 74/7 R; 74/6; 74/446; 123/179.26

[58] Field of Search ..... 74/7 R, 6, DIG. 10, 74/446, 459, 424.8 R; 290/38 R, 48; 123/179.26

[56] References Cited

U.S. PATENT DOCUMENTS

| | | | |
|---|---|---|---|
| 1,351,860 | 9/1920 | McGrath | 123/179.23 |
| 2,420,288 | 5/1947 | Miller | 74/7 R |
| 3,021,721 | 2/1962 | Hooven | 74/DIG. 10 |
| 3,024,780 | 3/1962 | Hamman | 74/7 R |
| 3,081,644 | 3/1963 | Hudgens et al. | 74/424.8 R |
| 3,200,665 | 8/1965 | Wells . | |
| 3,625,071 | 12/1971 | Harkness | 74/7 R |
| 3,643,522 | 2/1972 | Fullam | 74/459 |
| 3,818,768 | 6/1974 | Hardy | 74/7 R |
| 3,858,452 | 1/1975 | Gatland et al. | 74/424.8 R |
| 3,867,852 | 2/1975 | Schopf | 74/446 |
| 3,929,028 | 12/1975 | Kirkegaard . | |
| 4,339,113 | 7/1982 | Vosper | 254/13 |
| 4,651,229 | 3/1987 | Coli | 74/DIG. 10 |
| 4,848,174 | 7/1989 | Brown et al. | 74/89.15 |
| 5,596,902 | 1/1997 | McMillen . | |

FOREIGN PATENT DOCUMENTS

| | | |
|---|---|---|
| 1002244 | 3/1952 | France . |

*Primary Examiner*—David A. Bucci
*Assistant Examiner*—William C Joyce
*Attorney, Agent, or Firm*—Howard & Howard

[57] ABSTRACT

A two-piece pinion gear includes a metal outer portion and a plastic inner portion. The metal outer portion includes a plurality of gear teeth that are adapted to be engaged by a driving member. The plastic inner portion preferably includes a spiraled groove that is adapted to ride along a spiraled track on a spline shaft associated with an electric starting motor.

20 Claims, 1 Drawing Sheet

Fig-1
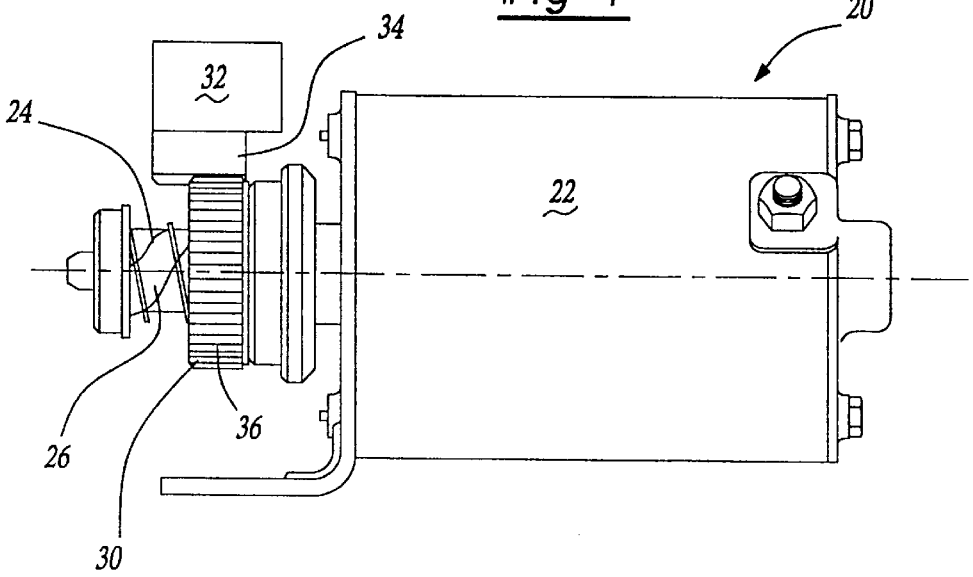
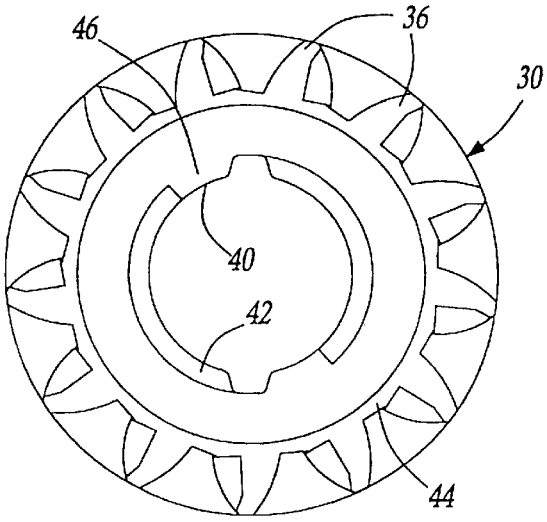
Fig-2A
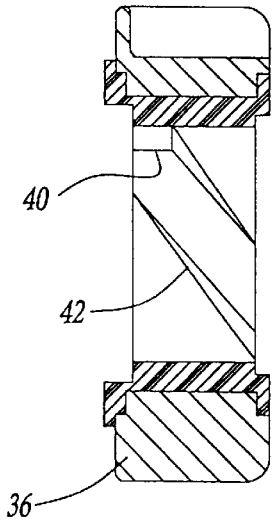
Fig-2B
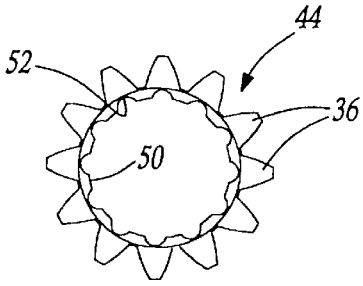
Fig-3
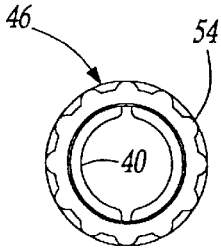
Fig-4

TWO-PIECE PINION GEAR

BACKGROUND OF THE INVENTION

This invention generally relates to a pinion gear having a metal portion and a plastic portion that is useful for a starting system for small engines.

Starting systems in small engines typically include and electric starting motor. An electric starting motor typically includes a plastic spline shaft that extends out of a motor housing. A plastic pinion gear is supported on the spline shaft and is engaged by a driving member or a ring gear. The pinion gear and the spline shaft driven by the starter motor rotate, causing the pinion gear to engage the drive member (ring gear), which starts the engine.

Since plastic spline shafts are used, plastic pinion gears typically were required. Metal pinion gears could not be used because of the undesirable wear caused on the spline shaft during typical starting cycles. Plastic pinion gears are not as durable as desired because the engagement of the driving member on the plastic gear teeth causes wear.

Therefore, there is a need for an improved pinion gear that will be more durable and still be accommodated on the plastic spline shafts typically associated with small engine starting systems.

SUMMARY OF THE INVENTION

In general terms, this invention is a two-piece pinion gear that has a metal outer portion and a plastic inner portion. The metal outer portion includes a plurality of radially outwardly extending gear teeth that are adapted to be engaged by a driving member to cause rotation of the pinion gear. The outer member includes a central opening through the center of the outer member. The central opening includes a plurality of first locking members equally spaced around the central opening. The plastic inner portion includes a plurality of second locking members along an outer edge of the inner portion. The first locking members and the second locking members engage to maintain the inner portion aligned with the outer portion. The inner portion includes a central bore that is adapted to be received upon the plastic spline shaft of a small engine starting system.

The various features and advantages of this invention will become apparent to those skilled in the art in the following detailed description of the presently preferred embodiment. The drawings that accompany the detailed description can be briefly described as follows.

BRIEF DESCRIPTION OF THE DRAWINGS

FIG. 1 is a diagrammatic illustration of a small engine starting system including a pinion gear designed according to this invention.

FIG. 2A is an elevational view of a pinion gear designed according to this invention.

FIG. 2B is a cross-sectional illustration taken along the lines B—B in FIG. 2A.

FIG. 3 is an elevational view of an outer pinion designed according to this invention.

FIG. 4 is an elevational view of an inner portion designed according to this invention.

DETAILED DESCRIPTION OF THE PREFERRED EMBODIMENT

FIG. 1 illustrates a small engine starting system 20 that includes an electric motor within a housing 22. A plastic spline shaft 24 extends out of the housing 22. The plastic spline shaft 24 preferably includes a spiraled track 26 extending along at least a portion of the length of the spline shaft. A two-piece pinion 30 is supported on the shaft 24.

A driving member 32 includes gear teeth 34 (schematically illustrated) that engage a plurality of gear teeth 36 on the pinion 30. As the pinion 30 causes the drive ring gear to rotate, the engine starts as desired. As those skilled in the art will appreciate the pinion 30 moves axially along the spline 26 as the two are rotating.

FIGS. 2A and 2B illustrate the two-piece pinion 30 in more detail. A central bore 40 through the center of the pinion 30 includes a spiraled groove 42. The spiraled groove 42 rides along the spiraled track 26 on the shaft 24 so that rotation of the shaft 24 results in rotation of the pinion 30.

Importantly, the pinion 30 includes an outer portion 44 that is made from a metal material. The preferred embodiment includes either a molded powdered metal piece or a cut steel part. An inner portion 46 is made from a plastic material. Plastic is required for the inner portion so that the interaction between the pinion 30 and shaft 24 will not cause undesirable wear on the shaft. The outer portion 44 is made from metal so that the engagement of the driving member 32 on the gear teeth 36 will not cause the undesirable wear that has been experienced with the prior art.

FIG. 3 illustrates the metal outer portion showing a central opening 50 through the metal portion 44. A plurality of locking members 52 preferably are equally spaced around the central opening 50. In the preferred embodiment the first locking members are axially extending grooves defined along the inner circumference of the outer portion 44. In the illustrated embodiment, each groove is radially aligned with a gear tooth 36.

FIG. 4 illustrates the inner portion 46. A plurality of second locking members 54 are provided along the outer perimeter of the inner portion 46. The second locking members preferably are tabs that are correspondingly shaped to the shape of the first locking members 52. When the inner portion 46 is received within the central opening 50 of the outer portion 44 the first locking members 52 and the second locking members 54 engage to maintain an alignment between the two portions.

When the inner portion is made from a press fit plastic piece, an adhesive preferably is used to maintain the inner portion within the outer portion 44. The illustrations of FIGS. 2A and 2B show an embodiment of this invention where the inner portion 46 is injection molded. In that embodiment, no adhesive is needed between the inner portion 46 and the outer portion 44.

This invention provides the advantage of having a pinion gear that is suitable for use on a plastic spline shaft yet durable enough to be repeatedly engaged by a metal driving member or ring gear. This represents an improvement over prior pinions, which typically last for approximately 3000 starting cycles when used with a small engine starting system. A pinion gear designed according this invention can last approximately ten times longer than the all-plastic pinions of the prior art.

The preceding description is exemplary rather than limiting in nature. Variations and modifications may become apparent to those skilled in the art that do not necessarily depart from the purview and spirit of this invention. The following claims must be studied to determine the legal scope of protection given to this invention.

We claim:

1. A starting device comprising:

a plastic spline shaft extending generally outward from a starter motor housing; and a pinion supported on said spline shaft, said pinion comprising:

a metal outer portion having a plurality of outwardly extending teeth and a central opening that includes a plurality of first locking members spaced about said central opening; and a single piece plastic inner portion having a plurality of second locking members spaced about an exterior surface on said inner portion, said second locking members engaging said first locking members to maintain said inner and outer portions in a selected alignment, said inner portion including a central opening to be received on said plastic spline shaft.

2. The pinion of claim 1, wherein said first or second locking members comprise grooves and the other of said first or second locking members comprise correspondingly shaped tabs.

3. The pinion of claim 1, wherein said first locking members comprise a plurality of radially and outwardly extending notches formed in said outer portion and said second locking members comprise a corresponding plurality of radially and outwardly extending tabs formed on said inner portion.

4. The pinion of claim 3, wherein said tabs have a generally rounded cross-section and said notches are correspondingly shaped to nestingly receive said tabs.

5. The pinion of claim 1, wherein there are an equal number of said teeth, first locking members and second locking members, respectively, and wherein each said corresponding first locking member and second locking member are radially aligned with one of said teeth.

6. The pinion of claim 5, wherein said teeth and said first locking members are equally circumferentially spaced about said outer portion and said second locking members are equally circumferentially spaced about said inner portion.

7. The pinion of claim 1, wherein said central opening through said inner portion includes a spiralled groove adapted to ride along a corresponding spiralled track on the spline shaft.

8. The pinion of claim 1, wherein said inner portion comprises a press fit piece of plastic and wherein said pinion further comprises an adhesive between said inner and outer portion to maintain said portions in axial alignment.

9. The pinion of claim 1, wherein said inner portion comprises injection molded plastic.

10. The pinion of claim 1, wherein said outer portion comprises cut steel.

11. The pinion of claim 1, wherein said outer portion comprises molded powered metal.

12. The pinion of claim 9, wherein said inner portion is injection molded into said central opening such that said inner portion is secured to said outer portion at an end of being injection molded.

13. A small engine starting device, comprising:

a starter motor housing;

a single-piece plastic spline shaft extending outwardly from said housing; and a pinion supported on said spline shaft and having a single-piece plastic inner portion having a central opening that is received upon said spline shaft and a plurality of first locking members spaced about an exterior surface on said inner portion, and included a metal outer portion having a plurality of radially outwardly extending gear teeth adapted to engage a driving member and a central bore through said outer portion including a plurality of second locking members spaced about said central bore that engage said first locking members such that said inner and outer portions rotate in unison.

14. The device of claim 13, wherein said spline shaft includes a spiralled track extending along a portion of a length of said shaft and said inner portion central opening includes a correspondingly shaped spiralled groove so that said pinion rotates with said spline shaft and moves along said spiralled track.

15. The device of claim 13, wherein said inner portion comprises a press fit piece of plastic and wherein said pinion further comprises an adhesive between said inner and outer portion to maintain said portions in axial alignment.

16. The device of claim 13, wherein said inner portion comprises injection molded plastic.

17. The device of claim 13, wherein said outer portion comprises cut steel.

18. The device of claim 13, wherein said outer portion comprises molded powdered metal.

19. The device of claim 16, wherein said inner portion is injection molded into said central opening such that said inner portion is secured to said outer portion as a result of being injection molded.

20. A small engine starting device, comprising:

a starter motor housing;

a plastic spline shaft extending generally outwardly from said housing; and a pinion supported on said spline shaft and having a single piece plastic inner portion having a central opening that is received upon said spline shaft and a plurality of first locking members, spaced about an exterior surface on said inner portion, and including a metal outer portion having a plurality of radially outwardly extending gear teeth adapted to engage a driving member and a central bore through said outer portion including a plurality of second locking members spaced about said central bore that engage said first locking members such that said inner and outer portions rotate in unison, wherein there are an equal number of said teeth, first locking members and second locking members, respectively, and wherein each one of said first locking members and second locking members are radially aligned with each one of said teeth.

* * * * *